US010753098B2

(12) United States Patent
Gregory

(10) Patent No.: US 10,753,098 B2
(45) Date of Patent: Aug. 25, 2020

(54) BOX GUTTER SYSTEM AND SUMP OVERFLOW DEVICE

(71) Applicant: PREVENTATIVE STRUCTURAL ENGINEERING PTY LTD, Lilydale (AU)

(72) Inventor: Rowan Warwick Gregory, Lilydale (AU)

(73) Assignee: DAM BUSTER IP PTY LTD, Melbourne, VIC (AU)

( * ) Notice: Subject to any disclaimer, the term of this patent is extended or adjusted under 35 U.S.C. 154(b) by 26 days.

(21) Appl. No.: 16/039,480

(22) Filed: Jul. 19, 2018

(65) Prior Publication Data

US 2019/0024377 A1 Jan. 24, 2019

(30) Foreign Application Priority Data

Jul. 20, 2017 (AU) ..... 2017100991
May 14, 2018 (AU) ..... 2018203366

(51) Int. Cl.
*E04D 13/064* (2006.01)
*E04D 13/08* (2006.01)

(52) U.S. Cl.
CPC ..... *E04D 13/0645* (2013.01); *E04D 13/0641* (2013.01); *E04D 13/08* (2013.01)

(58) Field of Classification Search
CPC ..... E04D 13/064; E04D 13/0641; E04D 13/0645; E04D 13/076; E04D 13/0767;
(Continued)

(56) References Cited

U.S. PATENT DOCUMENTS 248,328 A * 10/1881 Kaltenbach ..... E04D 13/064 52/15
1,085,474 A * 1/1914 Peterson ..... E04D 13/10 52/15

(Continued)

FOREIGN PATENT DOCUMENTS

AU 2017100163 A4 3/2017
CA 2661380 A1 * 2/2008 ..... E03B 3/02

(Continued)

OTHER PUBLICATIONS

Australian/New Zealand Standard, "Plumbing and drainage—Part 3: Stormwater Drainage"; AS/NZS 3500.3:2015, Mar. 2, 2015, 188 pages.

*Primary Examiner* — Patrick J Maestri
*Assistant Examiner* — Joseph J. Sadlon
(74) *Attorney, Agent, or Firm* — Ohlandt, Greeley, Ruggiero & Perle, L.L.P.

(57) ABSTRACT

An overflow device comprising a sump for a box gutter includes a primary sump receptacle with first and second end walls, a pair of sidewalls extending between and a basal wall, with a primary outlet port for the discharge of water; the second end walls is common in forming a first end wall of a second sump receptacle having a second end wall, opposed sidewalls, a bottom wall and a secondary outlet for the discharge of water. The common wall has an upper edge spaced below the upper edges of each of the first end wall of the primary receptacle, the second end wall of the secondary receptacle and of the opposed sidewalls of each receptacle. The overflow device has a width between at least equal to the width of the box gutter whereby the overflow device is adapted to be installed in relation to a first box gutter section such that:

(Continued)

the first end wall of the first sump receptacle extends transversely with respect to the box gutter to enable the overflow device to be sealed to the first section of the box gutter, the overflow device is adapted to be installed, if required, in relation to a second section of the box gutter such that the second end wall extends transversely with respect to the box gutter for sealing the overflow device to the second section of the box gutter; and such that, with the overflow device so installed, water can flow from the first section of the box gutter, over an upper edge of the first end wall of the primary receptacle, into the primary receptacle and discharge through the primary outlet port, and with the primary outlet port sufficiently blocked, water can overflow an upper edge of the common wall, into the secondary receptacle and through the secondary outlet port.

16 Claims, 6 Drawing Sheets

(58) Field of Classification Search
CPC ..... E04D 13/08; E02B 5/08; E02B 2201/50; E03F 1/00; E03F 5/106
USPC ..... 52/11, 12, 13, 14, 15; 210/162, 170.3
See application file for complete search history.

(56) References Cited

U.S. PATENT DOCUMENTS 2,887,073 A * 5/1959 Thompson ..... E04D 13/076 52/16
3,325,038 A * 6/1967 Ferney ..... E04D 13/08 52/11
3,550,381 A * 12/1970 South ..... E04D 13/0727 405/119
3,670,505 A * 6/1972 Weaver ..... E04D 13/068 405/121
3,821,512 A * 6/1974 Stanford ..... H05B 3/00 219/213
3,889,474 A * 6/1975 Frangmeier ..... E04D 13/0641 405/120
4,136,010 A * 1/1979 Pilie ..... E03F 1/002 210/164
4,251,970 A * 2/1981 Home ..... B21C 37/157 52/674
4,368,601 A 1/1983 Price
4,678,368 A * 7/1987 Helversen ..... E02B 5/08 405/118
4,852,308 A * 8/1989 Papenbrock ..... E04D 13/076 52/12
5,038,528 A * 8/1991 Brant ..... E04D 13/068 248/48.1
5,322,629 A * 6/1994 Stewart ..... B01D 24/002 210/767
5,419,838 A * 5/1995 DiTullio ..... E03B 11/14 210/747.3
5,535,554 A * 7/1996 Harris, Jr. ..... E04D 13/0409 210/474
5,584,147 A * 12/1996 Agee ..... E04D 13/0645 138/32
5,634,299 A * 6/1997 Gaston ..... E04D 13/076 210/163
5,746,912 A * 5/1998 Monteith ..... B01D 17/00 210/170.08
6,193,880 B1 * 2/2001 Bergeron ..... B01D 29/33 210/162
6,264,835 B1 * 7/2001 Pank ..... B01D 17/0208 210/170.03
7,112,274 B1 * 9/2006 Sanguinetti ..... B01D 29/01 210/163
7,309,420 B1 * 12/2007 Trangsrud ..... E03F 1/00 210/163
7,504,024 B1 * 3/2009 Batten ..... E03C 1/20 210/154
8,336,268 B2 * 12/2012 Delaquis ..... E06B 1/70 49/471
8,607,778 B1 * 12/2013 Sonne ..... E04D 13/068 248/48.1
9,038,320 B1 * 5/2015 Deakins ..... E04D 13/064
9,746,205 B2 * 8/2017 Teoh ..... F24S 20/40
9,963,881 B1 * 5/2018 Aleman ..... E04D 13/064
10,414,677 B2 * 9/2019 Harris ..... E04H 4/1281
2002/0073630 A1 6/2002 Warns
2006/0278573 A1 * 12/2006 Robinson ..... E04D 13/0767 210/460
2010/0181237 A1 * 7/2010 Duran ..... B01D 17/0211 210/162
2011/0314748 A1 * 12/2011 Smith ..... E04D 13/064 52/12
2012/0168419 A1 * 7/2012 Bublitz ..... E04D 13/0762 219/213

FOREIGN PATENT DOCUMENTS

EP 2615214 B1 * 7/2015 ..... E03B 3/03
FR 1215618 A * 4/1960 ..... E04D 13/064
NZ 220081 5/1990
WO WO-2010089521 A1 * 8/2010 ..... E04D 13/064

* cited by examiner

Fig 1
Prior art
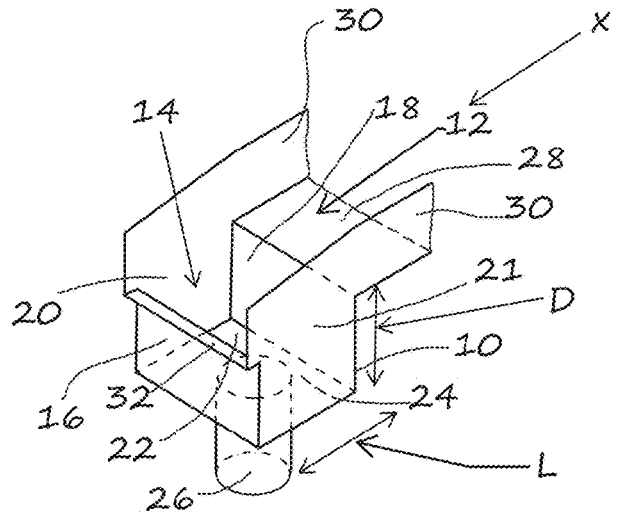
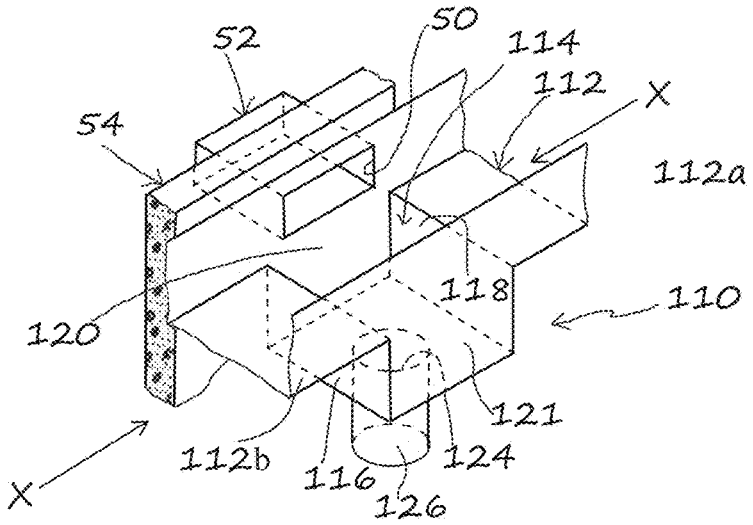
Fig 2
Prior art
Fig 3
Prior art
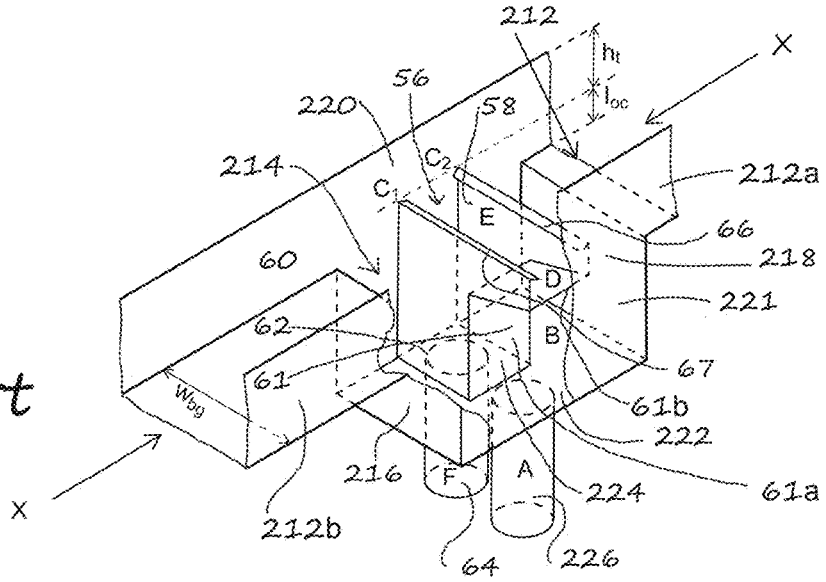

X-X

Y-Y

BOX GUTTER SYSTEM AND SUMP OVERFLOW DEVICE

CROSS-REFERENCE TO RELATED APPLICATIONS

This application claims priority from Australian Innovation Patent Application No. 2017100991 filed Jul. 20, 2017 and Australian Standard Patent Application No. 2018203366 filed May 14, 2018. Australian Innovation Patent Application No. 2017100991 filed Jul. 20, 2017 and Australian Standard Patent Application No. 2018203366 filed May 14, 2018 are incorporated herein by reference in their entirety.

FIELD OF THE INVENTION

The present invention relates to an overflow device for a box gutter that provides an alternative to known devices. In particular, but not exclusively, the invention relates to an overflow device that is an alternative to known sump devices for box gutters. However, in at least some contexts, the device of the invention can provide an alternative for rainhead devices for box gutters.

BACKGROUND TO THE INVENTION

Roof drainage systems need to be designed and installed with appropriate overflow provision, as failure to do so can result in serious damage to buildings and their contents. It is necessary to calculate the hydraulic capacity of a box gutter relative to the type of overflow device that is appropriate. The stormwater drainage code AS/NZS 3500.3:2015, entitled *Plumbing and Drainage—Part* 3: *Stormwater Drainage*, (herein referred to as "3500.3") specifies three types of overflow devices for installation with box gutters. These are a rainhead device, a sump with a side overflow device or a sump with a high-capacity overflow device. With each of these devices it is necessary to have regard to the specific, appropriate type of device into which a given box gutter is to discharge when designing a roof drainage system incorporating box guttering.

FIGS. 1 to 3 described later herein illustrate the three types overflow devices for box gutters specified in 3500.3. Of these, the rainhead (FIG. 1) operates in such a manner that an increase in the depth of water flow in the box gutter, operating up to its maximum design hydraulic capacity, is not required when the (normal) downpipe becomes blocked and the stormwater is required to overflow a wall forming a weir at the front of the rainhead and discharge to atmosphere. Conversely, both the sump/side overflow device of FIG. 2 and the sump/high capacity overflow device of FIG. 3 require an increase in the depth of flow in the box gutter when the normal downpipe is blocked, in order for the device to allow overflow to occur up to the maximum design hydraulic capacity of the box gutter.

The present invention relates to an alternative form of overflow device that complies with the objectives underlying 3500.3 and which enables performance at least comparable to devices as specified in 3500.3. The device of the invention can be used as an alternative to the sump/high capacity overflow as currently prescribed by 3500.3 and shown in FIG. 3. However, the device of the invention may be also used in lieu of the sump/side overflow device of FIG. 2, and it can even be adapted for use as an alternative to the rainhead device shown in FIG. 1.

BROAD SUMMARY OF THE INVENTION

According to the present invention, there is provided an overflow device comprising a sump for a box gutter, wherein the device includes: a primary sump receptacle defined by first and second opposed end walls, an opposed pair of sidewalls each extending between a respective side edge of each of the end walls, the primary receptacle having a basal wall extending between a lower edge of each of the end walls and also between a respective lower edge of each of the opposed sidewalls and a primary outlet port for the discharge of water received therein; the second of the opposed end walls is a common wall in forming a first end wall of a second sump receptacle, with the secondary sump receptacle having a second end wall opposed to the common wall, opposed sidewalls each comprising an extension of a respective side wall of the primary sump receptacle and extending between a respective side edge of each of the common wall and the second end wall, a bottom wall extending between a lower edge of each of the second end and common walls and a respective lower edge of each sidewall comprising a respective forward extension and a secondary outlet for the discharge of water received therein; the common wall has an upper edge that is spaced below the upper edges of each of the first end wall of the primary receptacle, the second end wall of the secondary receptacle and of the opposed sidewalls of each receptacle; the overflow device has a width between the side walls that is at least equal to the width of the box gutter whereby the overflow device is adapted to be installed in relation to at least a first section of the box gutter such that:

(i) the first end wall of the first sump receptacle extends transversely with respect to the box gutter to enable the overflow device to be sealed to the first section of the box gutter, and (ii) the overflow device is adapted to be installed, if required, in relation to a second section of the box gutter such that the second end wall extends transversely with respect to the box gutter for sealing the overflow device to the second section of the box gutter; and wherein the arrangement is such that, with the overflow device so installed in relation to at least the first section of the box gutter, water is able to flow from the first section of the box gutter, over an upper edge of the first end wall of the primary receptacle, into the primary receptacle for discharge through the primary outlet port, and such that when discharge through the primary outlet port is sufficiently blocked, water is able to overflow an upper edge of the common wall to be received into the secondary receptacle and discharged through the secondary outlet port. The primary outlet port is in the bottom wall of the primary sump receptacle, while the secondary outlet port is in the bottom wall of the secondary receptacle in one form of the overflow device. However, in another form, the overflow device differs in that the secondary outlet port is in one of the sidewalls, and adjacent to the bottom wall, of the secondary receptacle.

Most conveniently, each of the overflow device, the primary sump receptacle and the secondary sump receptacle, is substantially rectangular in top plan view. In that case, the sidewalls of each receptacle are substantially parallel with each other, with the end walls, including the common wall, also substantially parallel with each other and substantially normal to the side walls. Additionally, the bottoms walls may be substantially coplanar, while the bottom walls may be formed from a common sheet. However, to enable water to flow from the primary sump receptacle to the secondary sump receptacle by overflowing the common wall, and in order to minimize any risk of backflow in the box gutter and/or increase in water depth in the box gutter in the overflow condition, the common wall has an upper edge that is spaced sufficiently below the upper edges of each of the first end wall of the primary receptacle, the second end wall of the secondary receptacle and of the opposed sidewalls of each receptacle.

Preferably the volume of the primary sump receptacle, between the bottom wall of the primary receptacle and the upper edge of the common wall, is not substantially less than the volume of the secondary sump receptacle, between the bottom wall of the secondary receptacle and the upper edge of the common wall. More preferably those volumes are substantially equal or the volume the secondary receptacle exceeds that of the primary receptacle at least such that, in the event that flow from the primary outlet port of the primary receptacle being blocked to cause overflow to the second receptacle, any overflow from the primary receptacle to the second receptacle can be accommodated by the volume of the second receptacle and designed discharge from the secondary outlet port. Most preferably the primary receptacle is such that, with the primary outlet port unobstructed and free to provide designed discharge of water from the primary receptacle, the volume of the primary receptacle, relative to a box gutter appropriate for a given roofing form and geographic location, is such as to comply with 3500.3 in providing prescribed compliance for average recurrence interval (ARI) specified by 3500.3 for the box gutter. Thus, where the overflow device of the invention is adapted as an alternative to a sump/high capacity overflow as currently prescribed by 3500.3, the device of the invention is able to accommodate rainfall intensities for a duration of 5 minutes and an ARI of 100 years.

The primary outlet port preferably opens through the bottom wall of the primary sump receptacle and the secondary outlet port preferably opens through the bottom wall of the secondary sump receptacle. However, one or both of the outlet ports, most preferably the secondary outlet port, may open through a side wall, adjacent to the respective bottom wall. In both cases, the secondary outlet port discharges the storm water to atmosphere via an aerial 'overflow' down pipe. This 'overflow' downpipe is typically suspended at a suitable (design) grade below the horizontal in order to achieve the design hydraulic capacity of the device, and extends through an external wall of the building such that the overflowing water is visible, thereby alerting the building occupants or building owner that there is a blockage in the primary outlet port.

It is not usual for commercially available sumps for installation in relation to box gutters to fail to comply with AS/NZS 3500.3:2015, particularly 'internally' located sumps. There are several reasons for this non-compliance. For 'internally' located sumps, the only form of overflow device permitted by 3500.3 is the 'sump/high capacity overflow device', shown in FIG. 3, and described later herein. The construction of this device is relatively complicated, and it is also not straightforward to design. Consequently this overflow device is rarely constructed in a compliant manner. Most commonly, the internal weirs are not provided, and the overflow pipe simply protrudes above the design water level in the box gutter/sump for the design flow condition. When a blockage occurs in the normal downpipe, the water level must rise in the box gutter/sump, and flow into the overflow pipe. However, there is minimal head of water above the top of the overflow pipe, and consequently the hydraulic capacity in the design overflow condition is inadequate (note that 3500.3 requires the hydraulic capacity of the device in the overflow condition to be at least equal to the hydraulic capacity for the design flow condition). The overflow device of the present invention has a much simpler construction than the sump/high capacity overflow device, and also a much simpler hydraulic design that facilitates ready use in a compliant manner.

Commercial sumps, which are typically of a simple, open-top box form, usually are fitted in relation to an already installed box gutter by cutting an opening in the sole or pan of the box gutter, before or after installing the gutter, with the opening shaped to enable the sump to be lowered so as to be neatly received in the opening. Fasteners then are inserted though flanges extending outwardly around the top of the sump for securing the sump to the sole or pan of the gutter. If the width of the sump is the same, or nearly the same, as the box gutter, the two opposing flanges which are parallel to the box gutter, can be bent to a vertical position, and alternatively fastened to the side walls of the box gutter. A preferred overflow device of the invention most preferably is such that it can be placed in position at a required location relative to the area of roofing with which it is to be used before the box gutter is installed. The overflow device may be, and preferably is, also secured at the required location before installation of the box gutter. This procedure has the advantage that the sump covers the hole required for the sump in the box gutter support tray, thus removing a potential trip hazard during the gutter installation works. With the overflow device so positioned, the box gutter then is installed, with the arrangement depending on the location of the overflow device along the length of the gutter. In the latter regard, the overflow device may be positioned between the ends of successive box gutter lengths, or the overflow device may be at a terminal end of the box gutter.

In one embodiment of the preferred overflow device, the first end wall has an upper edge that is intermediate in height between the height of the common wall on the one hand and the height of each of the second end wall and the side walls, with the second end wall and the side walls preferably having a substantially common height above the or each bottom wall. Where the overflow device is to be used at a terminal end of the box gutter, the arrangement may be such that the terminal end of the gutter rests on the upper edge of the first end wall, between the side walls, of the device. To facilitate this, the overflow device preferably has an internal width between the side walls that slightly exceeds the external width of the box gutter to enable the gutter to be neatly received between the side walls. There may be a clearance of about one to two millimeters, on average, between the gutter and each side wall. This gap is typically filled with a silicone sealant, and metal rivets are installed to connect the box gutter to the device.

Where the overflow device is to be used between the ends of successive box gutter sections, the arrangement is such that water is to flow in a common direction in each of the gutter sections such that water flows into the device from an upstream one of the gutter sections, and away from the device in the other, downstream one of the gutter sections. The downstream end of the upstream gutter section rests on the upper edge of the first end wall, between the side walls, of the device, in the same manner as described for the terminal end of a box gutter. The downstream gutter section has an upstream end mounted in relation to the second end wall of the overflow device, in a manner such that the sole or pan of the downstream gutter section is above the upper edge of the first end wall and below the upper edge of the second end wall. If the lengths of gutter between the devices is the same, or similar, the arrangement may be such that the fall of the downstream is gutter section is substantially the same as that of the upstream gutter section, and preferably from a common height at the upstream ends of the gutter sections. If the lengths of the gutter sections between the devices is substantially different, the height at which the downstream gutter is mounted on the second end wall of device will be suitably adjusted to enable the top of all gutters and devices to be at the same level, this being equal to the level of the underside of the roof sheeting at the point at which it passes over the box gutter (3500.3 requires the roof sheeting to extend 50 mm beyond the side walls of the box gutters).

The preferred overflow device may have a flange projecting from the upper edge of the first end wall. The flange may project towards, but preferably projects away from, the second end wall and, in either case, may provide a platform on which the terminal end of a box gutter, or the downstream end of an upstream gutter section, is supported. The flange may be substantially parallel with the basal wall of the primary receptacle, although the flange preferably at a slight angle to the basal wall, such as to match the fall of the terminal end of the box gutter or of the upstream box gutter section.

Where the overflow device is to be used between the ends of successive box gutter sections, the upstream end of the downstream gutter section may be mounted in relation to the second end wall of the overflow device in a number of different ways. In one arrangement, the downstream gutter section may have a transverse end wall projecting upwardly from the sole or pan of the gutter section and between the side walls of the gutter section. With such an arrangement, the transverse wall may have a turned upper edge that defines a longitudinally extending, downwardly open channel able to fit over the upper edge of the second end wall of the overflow device and secure the downstream gutter section in relation to the device. However, it is preferred that an alternative arrangement enables both mounting of the downstream gutter section and the overflow device and that also may provide accommodation for longitudinal thermal expansion and contraction of the box gutter.

In one alternative mounting arrangement, the downstream gutter section is mountable in relation to the second end wall of the overflow device by means of a connector that is separate from the downstream gutter section connector. The connector may comprise a plate mountable on the device with a first of opposite main faces of the plate against the outer surface of the second end wall of the device. The plate has a flange projecting beyond the second of the opposite main faces, away from the first main face, such that the upstream end of the downstream gutter section can be supported on, or secured in relation to, the plate. In a preferred form the flange forms the web portion of a U-shaped flange, with the U-shaped flange having upstanding side flange portions against or adjacent each of which is located a respective side wall of the downstream gutter section, when that upstream end of the downstream gutter section is so supported or secured.

In the one alternative mounting arrangement, the upstream end of the downstream gutter section may be supported or secured in a manner enabling longitudinal thermal expansion or contraction in the box gutter. This preferably is by provision of an expansion joint between the overflow device and the downstream box gutter section. The expansion preferably is provided by an expansion strip joint that is resiliently expandable and contractible strip, such as of the type that is used to form a thermally adjustable connection between successive, directly interconnected box gutter sections. The expansion strip joint may be secured between the connector plate and the upstream end of the downstream gutter section, such as between the U-shaped flange of the connector mountable on the overflow device and a margin of the downstream gutter section at the upstream end. The securement may be provided in the manner illustrated at www.aquariusdist.com.au/products/expansion-strip-joint/ with reference to a joint formed between successive, directly interconnected box gutter sections. Note that a diagram showing a 'synthetic rubber expansion joint' is shown in FIG. 5.3.2 (C) of HB39:2015 Installation code for metal roof and wall cladding.

The overflow design according to the present invention may be specifically designed for each installation within the roof guttering system for the design catchment area of roof, and design rainfall intensity in accordance with 3500.3 Alternatively, the device may be manufactured in a number of pre-set sizes, such that the nearest size have a hydraulic capacity at least equal to the required design hydraulic capacity is selected. It is anticipated that the pre-set sizes will be the more likely commercialization form of the device.

BROAD DESCRIPTION OF THE DRAWINGS

FIG. 1 is a perspective view of a rainhead overflow device as illustrated in *Plumbing and Drainage—Part* 3: *Stormwater Drainage* section of 3500.3;

FIG. 2 is a perspective view of a sump/side overflow device as illustrated in that section of 3500.3;

FIG. 3 is a perspective view of a sump/high capacity overflow device as also illustrated in that section of 3500.3;

Figure 8:
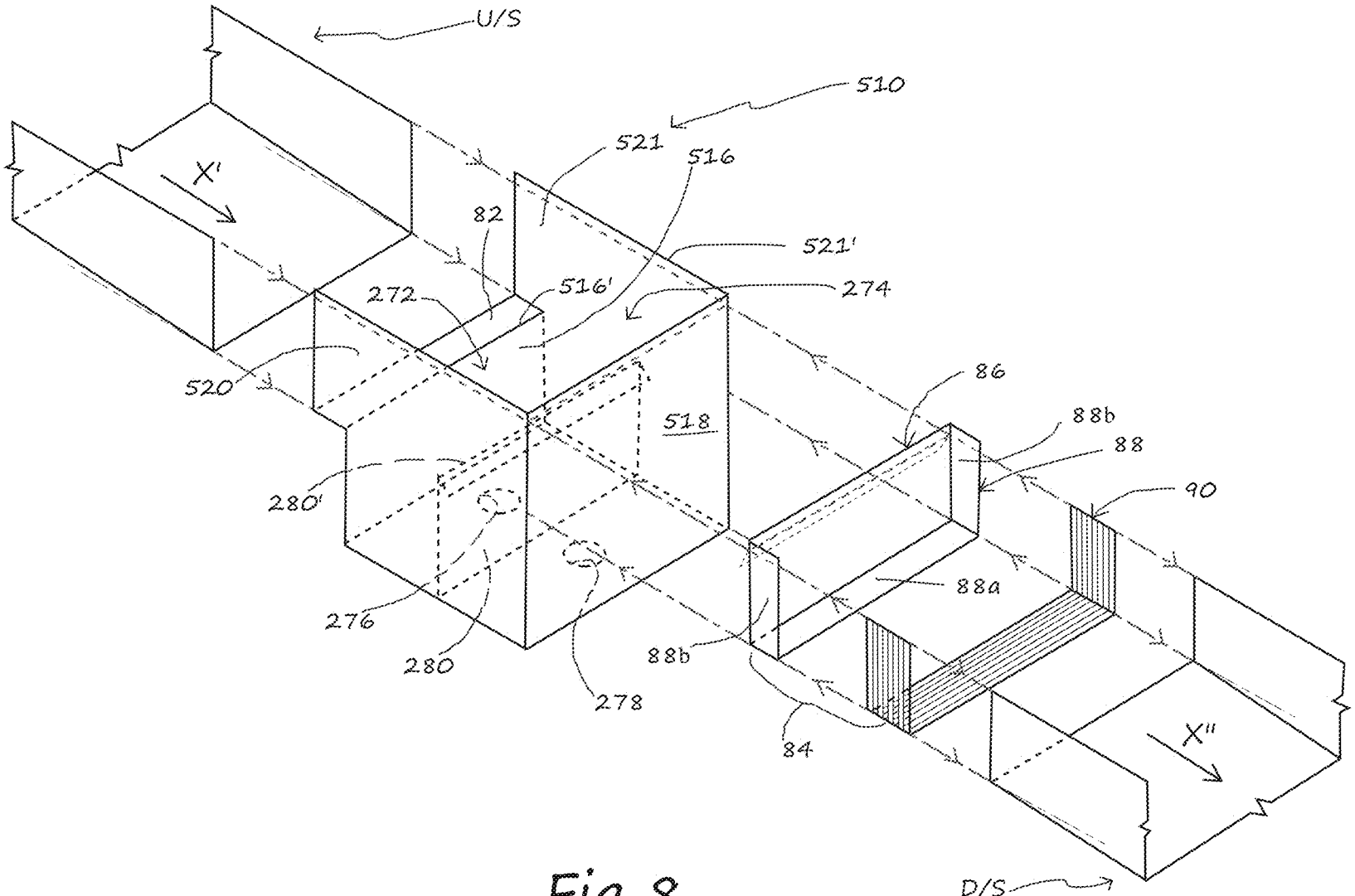
FIG. 8 is an exploded schematic view of an arrangement for installation of an alternative preferred form of overflow device according to the invention between successive box gutter sections.
Figure 9A:
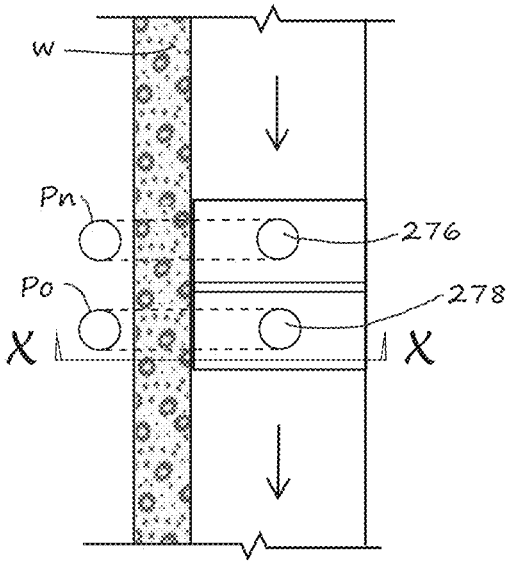
Figure 9B:
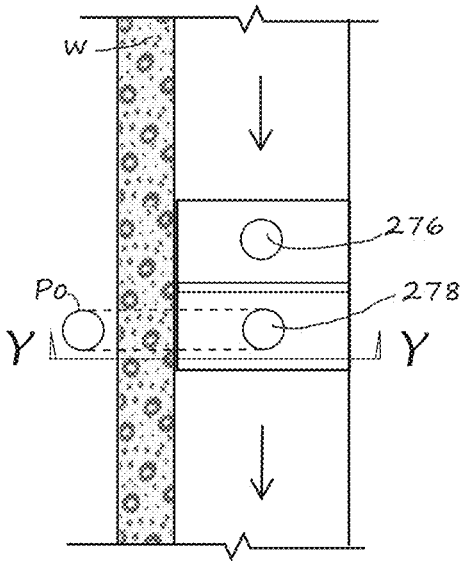
Figure 10A:
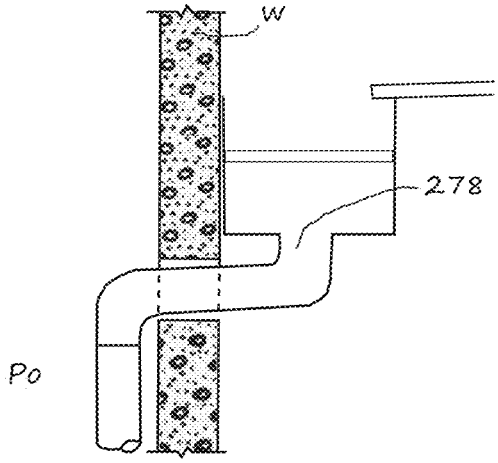
Figure 10B:
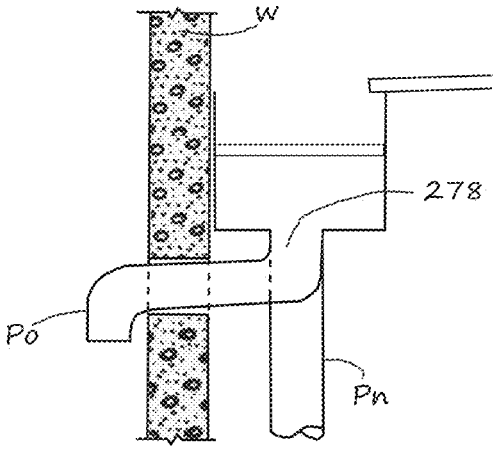

FIGS. 9A and 9B each show a plan view of a respective box gutter system, based on the arrangement of FIG. 8; and FIGS. 10A and 10B show respective sectional views on line X-X of FIG. 9A and Y-Y of FIG. 9B.

DETAILED DESCRIPTION OF THE DRAWINGS

FIG. 1 shows a rainhead 10 as installed in relation to a box gutter 12. The rainhead 10 comprises a rectangular box-like open-top vessel that has a chamber 14 bounded by upstanding front and rear end walls 16 and 18 joined by opposed, upstanding sidewalls 20 and 21 joining the end walls 16 and 18, and a bottom wall 22. A discharge outlet 24 is provided in bottom wall 22, with the periphery of outlet 24 having a depending skirt (not shown) to which a downpipe 26 is fitted. The width of the rainhead 10 across the box gutter 12 is to be at least equal to the width of the box gutter 12 and the box gutter 12 needs to be sealed to the rainhead 10. Also, the hydraulic capacity of the rainhead 10 must be no less than the design flow for the outlet end of the box gutter 12. Thus, in the arrangement shown, the relative dimensions of rainhead 10 and box gutter 12 are such that the rainhead 10 is secured in relation to box gutter 12 so a transverse end edge of the sole or pan 28 of gutter 12 is joined across the upper edge of end wall 18, and an upper extent of each side wall 20 and 21 above the upper edge of end wall 18 provides a continuation of a respective side wall 30 of the box gutter. To ensure that adequate overflow provision is made and any surcharge is accommodated the end wall 16 of the rainhead 10 defines an overflow weir 32 by an upper margin of the end wall 16 being turned forwardly away from end wall 18, so the weir 32 is sufficiently below the sole or pan 28 of box gutter 12.

The hydraulic capacity of the rainhead 10, determined by the distance between end walls 16, 18, the length between side walls 20, 21, the depth between weir 32 and bottom wall 22, and the area of the downpipe, must be no less than the design flow for the associated box gutter outlet. The arrangement is to be such that the rainhead 10 discharges through downpipe 26 during normal operation or, in the event of a blockage restricting flow through outlet 24 to downpipe 26, by discharge over weir 32 to atmosphere, in each case in such a way as to prevent damage to buildings and property. The rainhead 10 operates in such a manner that an increase in the depth of water flow in the box gutter 12, operating up to its maximum design hydraulic capacity, is not required when the downpipe 26 becomes blocked and the stormwater is required to overflow the weir 32 at the front of the rainhead 10 and discharge to atmosphere.

FIG. 2 shows a system in which a sump/side overflow device 110 is installed between the ends of sections 112*a* and 112*b* of box gutter 112. In the arrangement of FIG. 2 components corresponding to those of device 10 and box gutter 12 of FIG. 1 have the same reference numeral plus 100. Thus, in relation to flow in box gutter 112, device 110 receives water flowing from both sections 112*a* (on the right) and 112*b* (on the left) into chamber 114. With such flow, device 110 has opposing end walls 116 and 118, sidewalls 120 and 121, a bottom wall 122 and a discharge opening 124 communicating with a downpipe 126. However, in contrast to device 10, there is no weir, such as in the arrangement of FIG. 1. Rather an overflow outlet 50 is provided in one sidewall, with outlet 50 communicating with an overflow duct or channel 52. The arrangement is such that, if water flowing from the sole or pan 128 of box gutter sections 112*a* and 112*b* into chamber 114 is blocked from discharging via opening 124 and downpipe 126, the water head increases in chamber 114 until discharge occurs via overflow outlet 50 and overflow duct or channel 52. Whereas downpipe 126 extends down within the building above which the system is installed (and connects into the storm water drainage system for the building), water overflowing through outlet 50 and duct or channel 52 discharges to atmosphere through an external wall 54 of the building. The arrangement requires an increase in the depth of flow in the box gutter sections 112*a* and 112*b*, when the downpipe 126 is blocked, in order for the device 110 to allow overflow to occur up to the maximum (combined) design hydraulic capacity of the box gutter sections 112*a* and 112*b*.

The hydraulic capacity of the sump/side overflow device 110, determined by the length between end walls 116, 118, the width between side walls 120, 121, the depth of the sump (i.e. the height of end walls 116 and 118), and the area of the downpipe, must be no less than the total (combined) design flow for the associated box gutter sections 112*a* and 112*b*. The arrangement is to be such that the device 110 discharges through opening 124 and downpipe 126 during normal operation or, in the event of a blockage restricting flow through opening 124 and downpipe 126, water discharges though outlet 50 and duct or channel 52 to atmosphere, in each case in such a way as to prevent damage to buildings and property.

FIG. 3 shows a system in which a sump/high capacity overflow device 210 is installed between the ends of section 212*a* and 212*b* of box gutter 212. In the arrangement of FIG. 3 components corresponding to those of device 110 and box gutter 112 of FIG. 2 have the same reference numeral plus 100. Thus, in relation to flow in box gutter 212, device 210 receives water flowing from both sections 212*a* and 212*b*. With such flow, device 210 has opposing end walls 216 and 218, sidewalls 220 and 221 (with wall 221 shown partly broken away), a bottom wall 222 and a discharge opening 224 communicating with a downpipe 226. Again, there is no weir as in FIG. 1, while neither sidewall 220 and 221 is provided with an overflow outlet as in FIG. 2. Rather, within chamber 214, device 210 includes a sub-chamber 56 that is spaced from each of opposing end walls 216 and 218, shares bottom wall 222 and sidewalls 220 and 221 with chamber 214 and has opposing walls 58 and 60. Sidewall 220 of chamber 214 is common to chamber 214 and sub-chamber 56 over the full height of walls 58 and 60. However, the other sidewall 221 is common to chamber 214 and sub-chamber 56 over only an upper part of the height of walls 58 and 60. Over a lower part of their height, walls 58 and 60 are shaped to define edges spaced from the other sidewall 221, with the walls 58 and 60 joined at those edges by a sidewall 61 that has a lower part 61*a* extending from bottom wall 222 and an upper part 61*b* that is inclined upwardly and outwardly to the sidewall 221 so respective parts of chamber 214 between each of box gutter sections 212*a* and 212*b* and sub-chamber 56 are in communication between sidewall 61 and sidewall 221. The discharge opening 224 that communicates with (the normal) downpipe 226 is located externally with respect to sub-chamber 56 although, within sub-chamber 56, bottom wall 222 has another discharge opening 62 that communicates with a further (overflow) downpipe 64. Also, sub-housing 56 defines respective overflow weirs 66 and 67 by an upper margin of each wall 58 and 60 being turned inwardly, towards the other of walls 58 and 60, with each weir 66 and 67 being intermediate in height between the sole or pan 228 of box gutter sections 212*a* and 212*b*, and the upper edges of sidewalls 220 and 221 of chamber 214. The arrangement is such that, if water flowing from the sole or pan 228 of box gutter sections 212*a* and 212*b* into chamber 214 is blocked from discharging via opening 224 and downpipe 226, the water head increases in chamber 214 so water overflows weirs 66 and 67 to discharge via overflow outlet 62 and overflow downpipe 64. Downpipe 226 extends down within the building above which the system is installed (and connects into the storm water drainage system for the building), whereas overflow downpipe 64 is directed at a (design) grade below the horizontal towards, and the through, an external wall of the building, and then discharges to atmosphere in a visible manner. When the downpipe 226 is blocked, the arrangement requires an increase in the depth of flow in the box gutter sections 212*a* and 212*b* in order for the device 210 to allow overflow to occur up to the maximum design (combined) hydraulic capacity of box gutter sections 212*a* and 212*b*.

The hydraulic capacity of the sump/high capacity overflow device 210, is determined by the volume of chamber 214 externally of sub-chamber 56, the depth of the sump (i.e. the height of the opposing end walls 216 and 218), and the area of the (normal) downpipe 226. That hydraulic capacity must be no less than the combined design flows for the associated box gutter sections 212*a* and 212*b*. The arrangement is to be such that the device 210 discharges though opening 224 and downpipe 226 during normal operation or, in the event of a blockage restricting flow through opening 224 and downpipe 226, through opening 62 and downpipe 64, which is directed through an external wall and discharges to atmosphere as noted above, in each case in such a way as to prevent damage to buildings and property.

Figure 4:
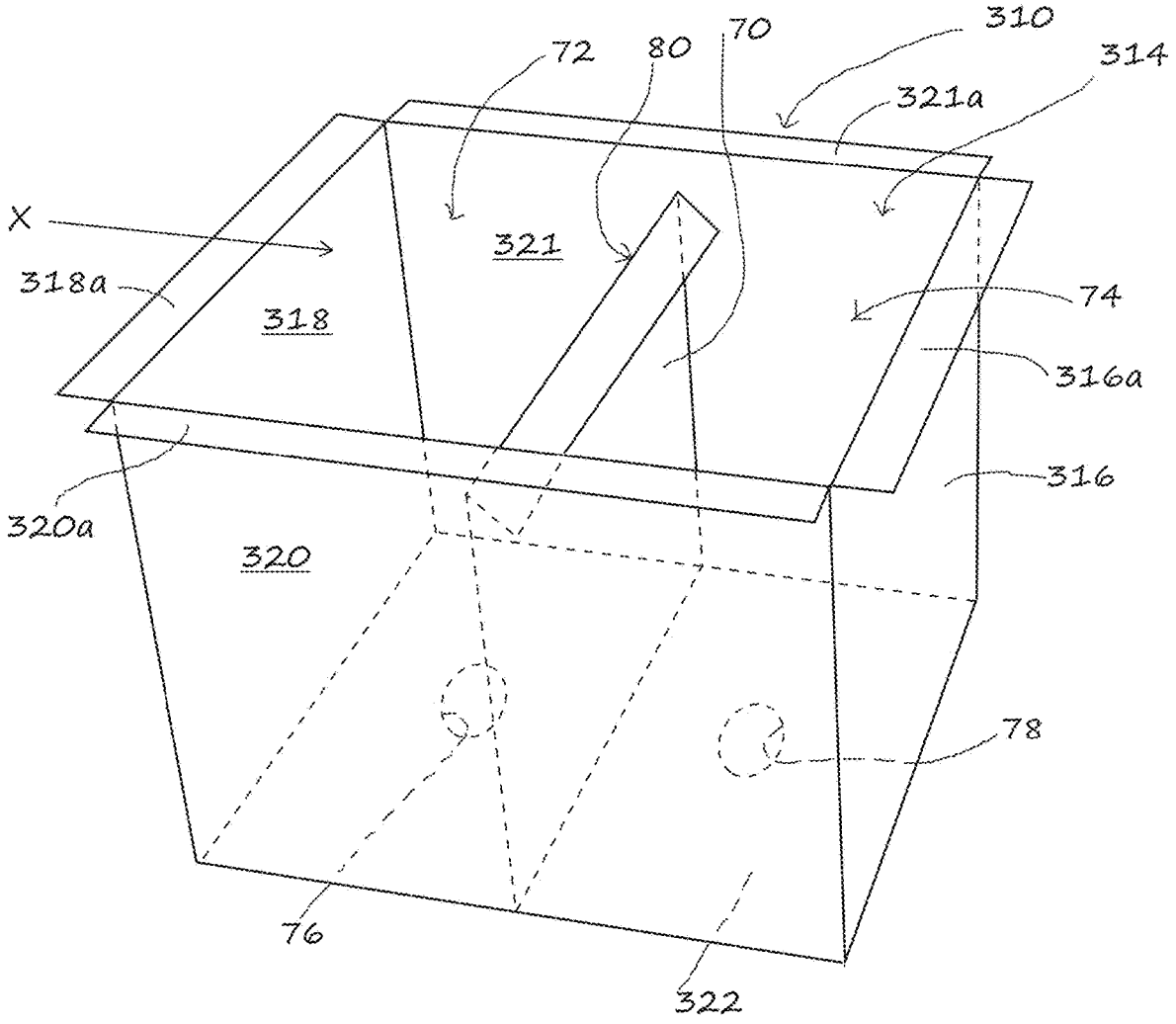
FIG. 4 is a schematic perspective view of an overflow device for a box gutter in accordance with the present invention.

FIG. 4 shows an overflow device 310 according to the present invention. The form shown for device 310 enables it to provide an alternative to the sump/high capacity device 210 of FIG. 3. However, as discussed below, the form can differ to provide an alternative to the sump/side overflow device 110 of FIG. 2, or be used as an alternative rainhead device 10 of FIG. 1 in some roof drainage/building designs.

The device 310 is such as to enable installation between successive box gutter sections in the manner of installation of device 210 of FIG. 2 between box gutter sections 212*a* and 212*b*. In the form shown, device 310 has a simple open topped rectangular form. Device 310 has opposed first and second end walls 316 and 318 with outwardly turned flanges 316*a* and 318*a* at the upper edges, sidewalls 320 and 321 with similar flanges 320*a* and 321*a*, and a bottom wall 322 defining a chamber 314. The flanges 316*a* and 318*a* overlap and are securable to the sole of a respective one of the successive gutter sections, while flanges 320*a* and 321*a* can be turned down over respective sides of the gutter sections. Intermediate of, and centrally between end walls 316 and 318, the device 310 has a partition 70 that divides chamber 314 into a first sub-chamber 72 and a second sub-chamber 74, with bottom wall 322 having a respective outlet 76 and 78 in the sub-chambers 72 and 74, with each of outlets 76, 78 having a respective associated downpipe (not shown). The partition 70 defines a weir 80 below the height of end walls 316 and 318, and side wall 320 and 321, by being provided with an upper margin that is turned forwardly towards end wall 316. The arrangement is such that, if water flowing from an upstream box gutter section over end wall 318 into first sub-chamber 72 is blocked from discharging, via outlet 76 and an associated downpipe, the water head increases in sub-chamber 72 until water overflows weir 80 into second sub-chamber 74, to discharge via overflow outlet 78 and the associated downpipe.

The hydraulic capacity of the overflow device 310, determined by the respective volume of each sub-chamber 72 and 74 below the height of weir 80 above bottom wall 322, and the area of outlet 76 and its associated ('normal') downpipe must be no less than the design flow for the associated upstream box gutter. The arrangement is to be such that the device 310 discharges through outlet 76 and its associated downpipe during normal flow conditions or, in the event of a blockage restricting flow through outlet 76, by flow over weir 80 into sub-chamber 74 and discharge through outlet 78 and its associated overflow downpipe, which is directed through an external wall and discharges to atmosphere through an external wall in the building, in each case in such a way as to prevent damage to buildings and property. The device 310 operates in such a manner that an increase in the depth of water flow in the upstream box gutter section, operating up to its maximum design hydraulic capacity, is not required when the downpipe associated with outlet 76 becomes blocked and the stormwater is required to overflow the weir 80 to the front of the device 310 and discharge to atmosphere through outlet 78 and its associated overflow downpipe.

The sub-chambers 72 and 74 of device 310 comprise that which earlier herein are referred to as a primary and a secondary sump receptacle. Preferably the volume of the sub-chamber 72, between the bottom wall 322 and the upper edge of the common wall, comprising the weir 80 of partition 70, is not substantially less than the volume of the sub-chamber 74, between the bottom wall 322 and the weir 80. More preferably those volumes of sub-chambers 72 and 74 are substantially equal, or the volume sub-chamber 74 exceeds that of sub-chamber 72 at least such that, in the event that flow from the primary outlet port comprising outlet 76 being blocked to cause overflow to the sub-chamber 74, any flow over weir 80 can be accommodated by the volume of the sub-chamber 74 and designed discharge from outlet 78. Most preferably the sub-chamber 72 is such that, with the outlet 76 unobstructed and free to provide designed discharge of water from sub-chamber 72, the volume of sub-chamber 72, relative to a box gutter appropriate for a given roofing form and geographic location, is such as to comply with 3500.3 in providing prescribed compliance for the average recurrence interval (ARI) for the box gutter. Thus, where the overflow device 310 is adapted as an alternative to a sump/high capacity overflow as currently prescribed by 3500.3, the device 310 is able to accommodate rainfall intensities for duration of 5 minutes and an ARI of 100 years, in both the normal flow, and overflow, conditions.

The overflow device 310 operates in a hydraulically similar manner to a rainhead device 10 of FIG. 1, rather than in the manner of a conventional sump/high capacity overflow device 210 of FIG. 3. Under normal flow conditions, the stormwater flows over the end of the box gutter into the sub-chamber 72, with the downpipe (not shown) located at the bottom wall outlet 76 of the sub-chamber 72. Consequently, in the normal flow condition, the device 310 operates in exactly the same manner as a rainhead 10. In the overflow condition, when normal downpipe at outlet 76 becomes blocked, the sub-chamber 72 fills with water, and then the water overflows a 'sharp crested' weir 80, into a second sub-chamber 74. An overflow downpipe (not shown) is located at the bottom wall outlet of the second sub-chamber 74, which is typically the same size as the normal downpipe. For a rainhead 10 as in FIG. 1 that is designed to 3500.3, this code prescribes that the top of the weir 32 be located 25 mm below the sole or pan 28 of the box gutter 12. Consequently, although this dimension does not necessarily need to be adopted for the device 310 of the invention, if it is adopted, the hydraulic design prescribed by 3500.3 for rainheads is equally applicable for the invention. The device 310 differs from rainhead device 10 in that, in the overflow condition, the water overflows the weir 80 into the second sub-chamber 74, and then flows into the overflow downpipe associated with outlet 78, which is directed outside the building, discharging to atmosphere in a visible manner (and also clear of building). If the size of the second sub-chamber 74 is selected to match the size of the first sub-chamber 72, and the overflow downpipe is the same size as the normal downpipe, then no hydraulic design is required for the overflow condition, since the hydraulic flow rate in the overflow condition is identical to that in the normal flow condition, and the geometry of the overflow chamber 74 is effectively a mirror image of the (normal flow) chamber 72 about the partition wall 70. Therefore, if the top of the weir 80 in the overflow device 310 is located 25 mm below the sole or pan of an upstream box gutter section (not shown), the device 310 can be designed in accordance with 3500.3 as though it were a rainhead.

Typically, a sump/high capacity overflow device as in FIG. 3 is located within an 'internal' box gutter, i.e. a box gutter that is not located immediately adjacent to an external wall. Where a box gutter is located parallel, and adjacent to, an external wall (which includes a parapet wall, preventing the usage of an eaves gutter), then the second type of overflow device, a sump with side overflow device 110 as in FIG. 2 is typically used. Having regard to the description of device 310 of FIG. 4, it will be appreciated how the device 310 can be modified for use as an alternative for a sump/side overflow device as shown in FIG. 2. This is achieved by directing the overflow downpipe a short distance (nominally half the width of the box gutter), in a direction perpendicular the box gutter, to the external wall, and with the downpipe then passing through the external wall, within a suitably oversized hole, to allow the downpipe to be sealed to the wall, allowing it to then discharge to atmosphere.

Similarly, it will be appreciated that the device can be located at the end of a box gutter, which is located either internally or immediately adjacent to, and parallel with, an external wall, and be effectively used in lieu of (an externally located) rainhead. This is achieved by directing the overflow pipe a short distance (nominally half the length of the overflow chamber 74) in a direction parallel to the box gutter, and through a suitably oversized hole to allow the downpipe to be sealed to the wall, allowing it to then discharge to atmosphere.

In all three cases where the device 310 can be used in lieu of rainhead device 10, sump and side overflow device 110, and sump/high capacity overflow device 210, it would be possible for the overflow outlet 78 to be instead located at, or near, the bottom of one of the three walls 316, 321 or 322, allowing the overflow downpipe connected to 78 to be directed to an external wall (having a design grade below the horizontal to achieve the required hydraulic capacity), without the requirement for a near 90 degree bend in the overflow pipe. This alternate overflow arrangement would require an increased depth of the device; however, this increased depth would be less than the depth required for the overflow pipe to be bent at a near 90 degree angle.

Comparison of the Overflow Device of the Invention with Overflow Devices Currently Prescribed by 3500.3 for a Box Gutter A comparison of the overflow device 310 of the invention with the sump/high capacity overflow device 210 reveals that:

(a) The device 310 is greatly simpler in its construction than device 210.

(b) The device 310 accepts water from a box gutter on one side of the device only, whereas device 210 accepts water from box gutters located on both sides of the device. This difference in operation permits the simple construction of device 310, as in the overflow condition, water only overflows one weir (rather than two) prior to entering the overflow chamber 74, whereas, it must overflow two weirs for device 210 before entering overflow chamber 56.

(c) Whilst the device 310 only accepts water from the box gutter in one direction, this aspect of the device does not diminish its ability to be used efficiently in the design of roof drainage. To the contrary, the device 310 will commonly simplify the roof drainage design/installation, since, firstly the box gutter does not need to change grade between devices, and secondly, since larger buildings are typically set out on regularly spaced grids, the roof catchment area to each device will typically be the catchment area between grids. This avoids the devices at the ends of the box gutter from having a roof catchment area based on half the distance between grids. Consequently all devices, if located at equally spaced grids, can have the same roof catchment area, resulting in a simplification and efficiency of the design. Refer to the roof drainage example below.

(d) As a consequence of the device 310 only accepting water flow from the box gutter on side, side, a 'stop end' will be required to the box gutter on the other side of the device (the chamber 74 side), however, 'stop ends' are relatively simple and easy to install within box gutters.

(e) The depth of a box gutter fitted with a rainhead and overflow device 10 is not affected by the depth of the water in the box gutter when the downpipe becomes blocked and the overflow operates. Conversely, for box gutters fitted either with a sump and side overflow device 110, or a sump/high capacity overflow device 210, an increase in depth in water in the box gutter is required in order for the water to overflow when the (normal) downpipe becomes blocked. As the device 310 operates in a hydraulically similar manner to a rainhead, the depth of water in the box gutter is also not affected when the downpipe becomes blocked, and the water overflows weir 80 into chamber 74.

A comparison of the overflow device 310 of the invention with the sump/side over device 110 reveals that:

(f) The device 310 is considered to be simpler in its construction and installation within a building than device 110 because the rectangular overflow duct is replaced with a circular overflow downpipe, which is typically significantly easier to pass through an external wall than a rectangular duct.

(g) As noted in (e) above, an increase in depth in water in the box gutter is not required in the overflow condition (h) In considering whether to use device 310 in lieu of device 110, it is noted that, in some cases, device 310 may require a greater roof cavity depth (height between the top of the ceiling, and the underside of the roof), in which case device 110 may be preferable. However, in other cases, the depth of the roof cavity may not be a critical aspect of the building design, particularly if device 310 has been used elsewhere in the roof to replace device 210, since where device 210 or 310 is used, an adequate roof cavity depth is required to enable to overflow aerial downpipe to traverse, above the ceiling, to the external wall. In other words, in roofs where device 310 is adopted in lieu of device 210, and device 110 is also required, it is more likely that it will be preferable to use device 310 in lieu of device 110.

(i) Similarly to where device 310 is used in lieu of device 210, and there is a box gutter located on both sides of the device (noting that the box gutter may be located on side only in some cases, such as when the device is located in the corner of a roof), a stop end will be required in the box gutter on one of the device (the chamber 74 side).

The following comparison of the Invention device 310 is made to the rainhead device 10 is made:

(j) As previously noted, device 310 operates in a similar manner to device 10, and is no more complicated in its construction than device 10.

(k) In some cases, where an overflow device is used at the end of a box gutter, it may not be possible to install a rainhead device 10 if the outer face of the external wall located perpendicular to the box gutter is located on a property boundary (since device 10 cannot be located within the adjoining property). In these cases, it may be preferable to use device 310 in lieu of device 10, noting that the overflow downpipe can be directed through an alternate external wall, which is not located on a property boundary.

(l) Similarly to item (g), where device 310 is used in lieu of device 210, it is more likely that device 310 will be preferable to device 10, since adequate provision will already have been made for overflow pipes to be located within the roof cavity space.

Example of Usage of Device 310 in Lieu of Devices 210, 110 & 10

Figure 5:
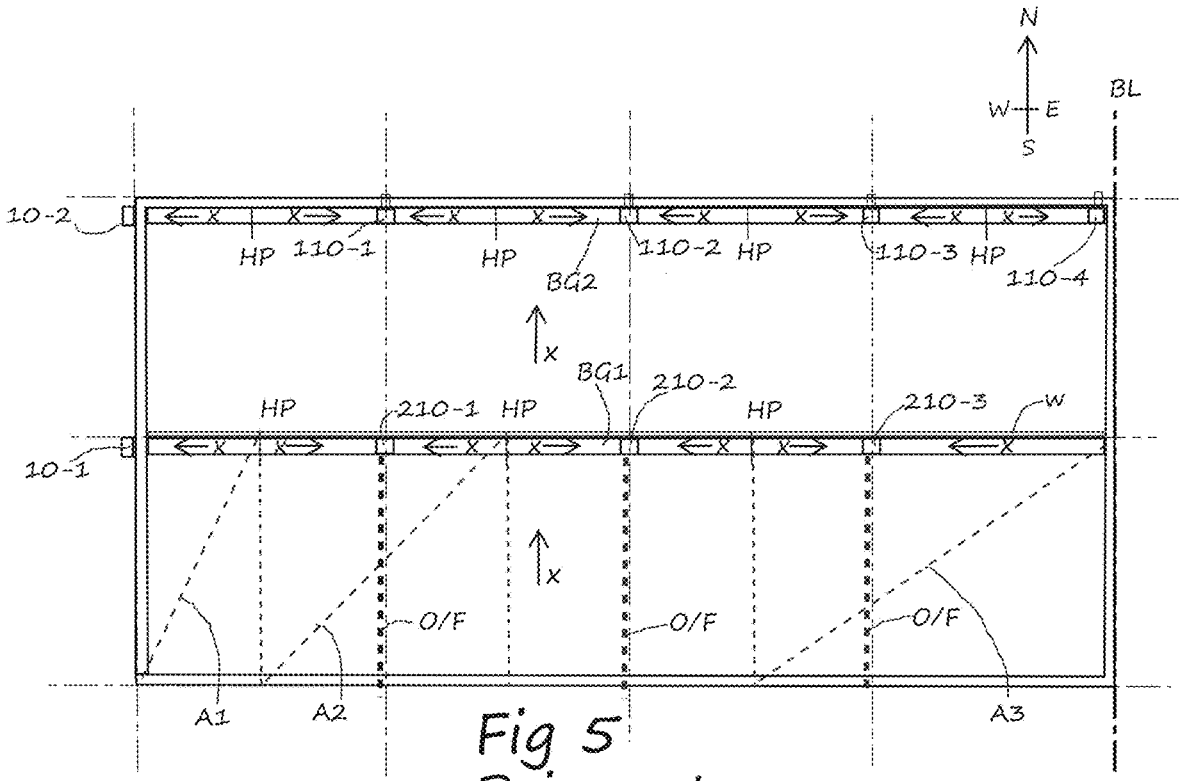
Fig 5 Prior art
FIG. 5 is a conventional roof drainage design in accordance with 3500.3.
Figure 6:
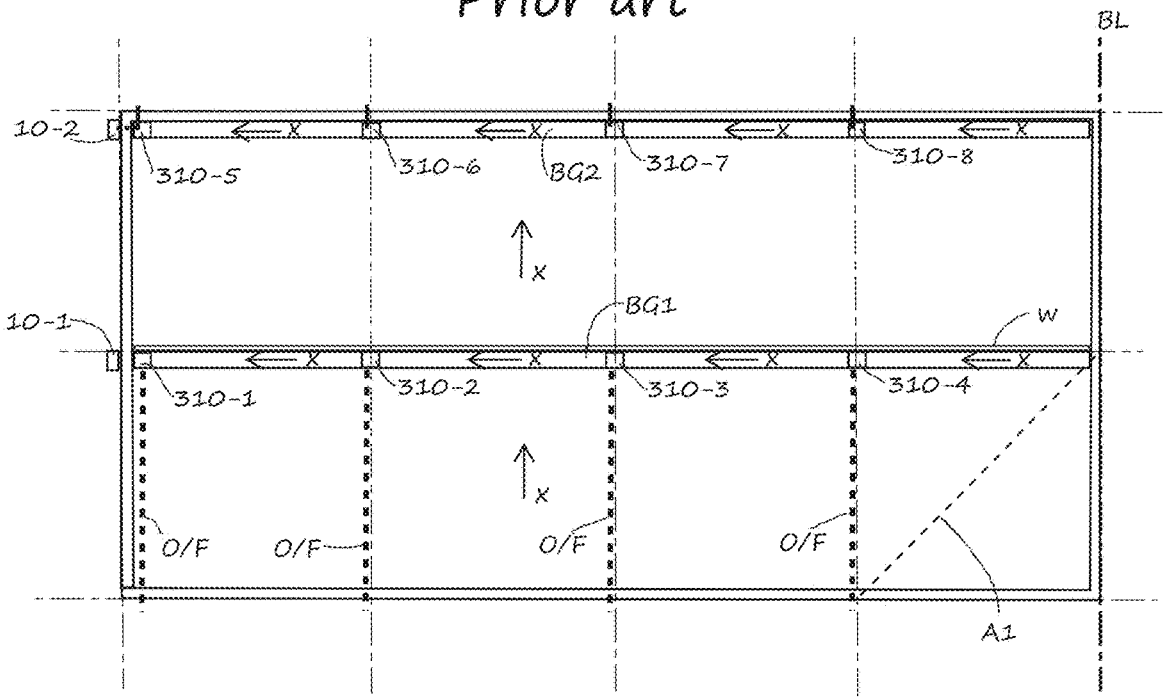
FIG. 6 is similar to FIG. 5, but with installation of overflow devices according to the present invention.

FIG. 5 shows an example of a roof design in which overflow devices 210, 110 & 10 have been installed in relation to two box gutters. FIG. 6 shows the same roof design as FIG. 5, but utilizing overflow devices 310 according to the invention. In FIGS. 5 and 6, the roof storm water design (for the building) comprises two roof sections (southern and northern), both of which falls to the north, into box gutters BG1 and BG2 respectively. On the north side of BG1, there are windows above BG1, separating the two roof halves. This type of roof is commonly referred to as a saw-toothed roof. FIG. 5 shows the roof drainage design using overflow devices currently prescribed by 3500.3, i.e. devices 10, 110 & 210, (distinguished as 10-1 and 10-2; 110-1, 110-2 and 110-3; and 210-1, 210-2 and 210-3). Between successive 110 devices in gutter BG1 and successive devices 210 in gutter BG2, the respective box gutter section falls in opposite directions to each device from an intermediate high point HP. FIG. 6 shows the same roof, but with device 310 being used in lieu of all devices 10, 110 & 210, and with each of gutters BG1 and BG2 falling in to the west along its full length. The grid spacings in both the EW and NS directions are nominally specified as 10 m. A comparison of FIGS. 5 and 6 warrants the following comments:

(i) In FIG. 5, it can be seen that the roof catchments areas (ignoring the effect of the roof slope) to devices 10-1, 210-1 and 210-3 are 50 $m^2$, 100 $m^2$, and 150 $m^2$ respectively, whereas in FIG. 6, all devices 310 have a roof catchment area (also ignoring the effect of the roof slope) of 100 $m^2$, resulting in an efficiency in the hydraulic design for the roof.

(ii) In FIG. 5, water flow in the box gutters is required in both the east and west directions, in most cases requiring a change in grade of the box gutter between devices. This change in grade occurs at the 'high point' in the box gutter, denoted HP in FIG. 5. In FIG. 6, however, both box gutters flow towards the west, and no change in grade is required in the box gutter between the devices.

(iii) At the ends of box gutters, either devices 10 or 310 may be used. Where rainhead device 10 is used, the (normal) downpipe will be located external to the building, whereas, when 310 is used, the normal downpipe is required to be accommodated within the building (this may be able to be fitted within the external wall). The overflow downpipe to 310 could extend a short distance and be passed through the eastern external wall (in such a manner as previously described), or it could be passed through the southern external wall (as shown for device 310-1), or the northern external wall (as shown for device 310-5).

(iv) As each device 310 receives the same roof catchment area, the same size of device 310 can be used in all cases, resulting in a simplification in the design and installation of the overflow devices for the building.

In each of FIGS. 1 to 6, the arrows 'X' designate the direction of water flow in a box gutter or over a roof. In FIG. 1, 'D' and 'L' respectively designate 'depth' and 'length' as in AS/NZS 3500.3. In FIGS. 5 and 6:

(v) 'A1', 'A2' and 'A3' designate roof areas;

(vi) 'W designates windows over;

(vii) 'O/F' designates overflow downpipes;

(viii) 'BG1' and 'BG2' designate box gutters 1 and 2; and (ix) 'HP' indicates a box gutter high point.

Figure 7:
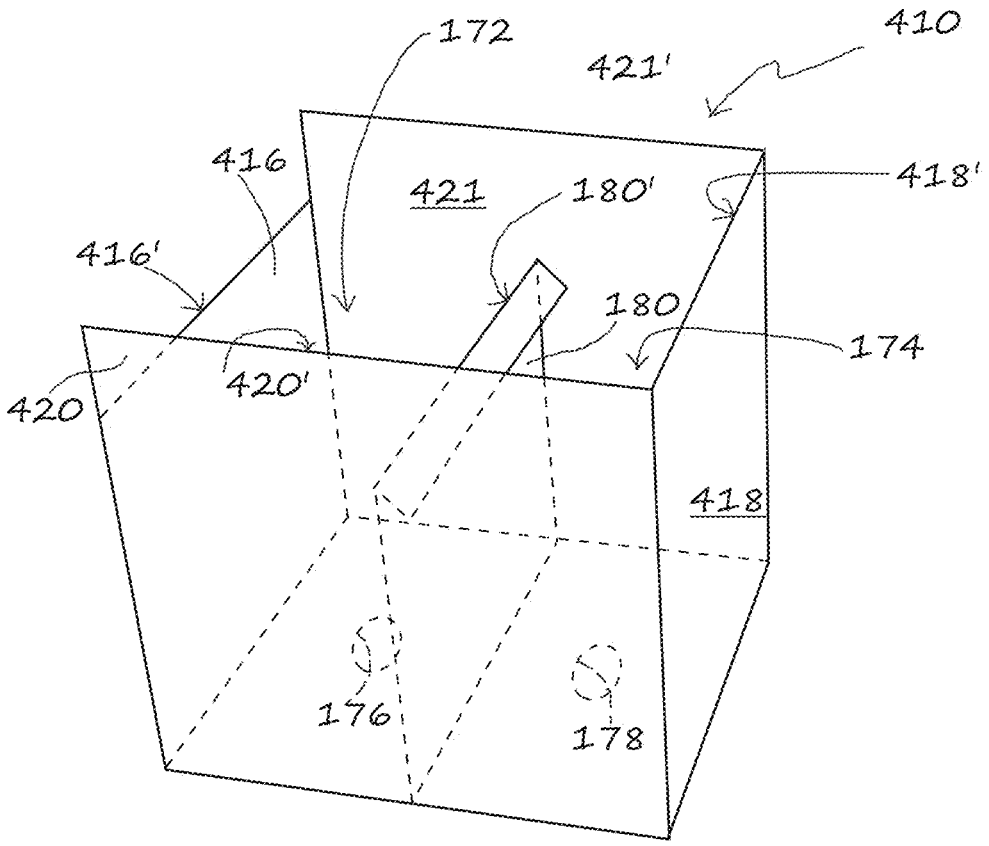
FIG. 7 is a schematic perspective view of a preferred form of overflow device in accordance with the invention.

FIG. 7 shows a preferred form of overflow device 410 according to the invention. The device 410 generally will be understood from the description of device 310 of FIG. 4, and parts of device 410 corresponding to parts of device 310 have the same reference numeral, plus 100. Also, description of device 410 is limited in large part to detail by which it differs from device 310.

The overflow device 410, comprising a sump for a box gutter, has side walls 420 and 421 and a second end wall 418 that have a respective upper edge 420', 421' and 418' that have a common height that is above than the upper edge 416' of the first end wall 416. However edge 416' is above the height of upper edge 180' of weir 180 of the partition 170 comprising a common wall between first and second sump receptacles or sub-chambers 172 and 174 having respective outlets 176 and 178. Also, none of edges 416', 418', 420' and 421' has an out-turned flange corresponding to flanges 316*a*, 318*a*, 320*a* and 321*a* of device 310 of FIG. 4, although flanges can be provided if required and appropriate. A somewhat similar overflow device 510 is shown in FIG. 8, and a further understanding of the use and installation of device 410 will be gained from the description of the system of FIG. 8.

In FIG. 8 there is shown an exploded view of an overall length of a box gutter system having a device 510 according to the invention, comprising a sump, installed between an upstream box gutter section U/S and a downstream gutter section D/S. Parts of the device 510 that correspond to parts of device 410 of FIG. 7 have the same reference numerals plus 100. The principle difference is that the first end wall 516 has an upper edge 516' that is defined by a substantially perpendicular flange 82 that extends from the edge 516', in a direction away from the second end wall 518, while each side wall 520 and 521 extends across a respective end of flange 82.

The first end wall 516 has a height that positions the flange 82 at an intermediate height between the height of the weir 182 and the substantially common height of each of the walls 518, 520 and 521. Where the overflow device is to be used at a terminal end of the box gutter, the terminal end of the gutter rests on the flange 82 at upper edge of the first end wall 516, between the side walls 520 and 521. To facilitate this, the overflow device 510 preferably has an internal width between the walls 520 and 521 equal to the overall width of the box gutter, plus a clearance of about one to two millimeters on both sides in order to accommodate the box gutter, and to allow a silicone sealant to be installed as appropriate between the outer walls of the box gutter, and inner face of walls 82, 520 and 521.

However, in the system of FIG. 8, the overflow device 510 is to be used between the ends of successive box gutter sections U/S and D/S. The width of device 510 between walls 520 and 521 slightly exceeds the external common width of the box gutter sections U/S and D/S so the downstream end of gutter section U/S can be neatly received between the walls 520 and 521. The arrangement is such that water is able to pass into gutter section U/S from adjacent roof areas (not shown) and then flow, in the direction of arrow X', along and from section U/S into sump receptacle 272 of the device 510 to discharge from device 510 via outlet 276. In the event of a blockage sufficiently preventing discharge through outlet 276, the water overflows the upper edge 280' of weir 280 to enter receptacle 274 and discharge via outlet 278. Also, water passing into section D/S from adjacent roof areas is able to flow in the section D/S, away from device 510 in the direction of arrow X". The downstream end of section U/S rests on the flange 82 of wall 516, between the side walls 520, 521 of device 510, as in an arrangement for the terminal end of a box gutter. The downstream section D/S has an upstream end mounted in relation to the second end wall 518 of the device 510, in a manner such that the sole or pan S/P of gutter section D/S is above the flange 82 end wall 516 and below the upper edge of end wall 518. If the lengths of the gutter sections between the devices is substantially different, the height at which the D/S is mounted on the second end wall of device will be suitably adjusted to enable the top of both/all gutters and devices to be at the same level, this being equal to the level of the underside of the roof sheeting at the point at which it passes over the box gutter (3500.3 requires the roof sheeting to extend 50 mm beyond the side walls of the box gutters).

The downstream gutter section D/S is mountable in relation to the second end wall 518 of the overflow device 510 by means of a connector system 84 that is separate from the downstream gutter section D/S. The connector system 84 includes a plate 86 mountable on the second end wall 518 device 510, with a first of opposite main faces of the plate 86 against the outer surface of the wall 518. The plate has a U-shaped flange 88 projecting beyond the second of the opposite main faces, away from the first main face, such that the upstream end of the downstream gutter section D/S can be supported on, or secured in relation to, the plate 86, and also fully sealed to connector system The flange 88 has a horizontally disposed web portion 88*a*, relative to which the upstream end of gutter section D/S is supported, and upstanding side flange portions 88*b* against or adjacent each of which is located a respective side wall of the downstream gutter section D/S, when that upstream end of section D/S is so supported or secured.

In the arrangement shown in FIG. 8, the upstream end of gutter section D/S is supported or secured in a manner enabling longitudinal thermal expansion or contraction an overall box gutter including the system of FIG. 8. For this the connector system 84 further includes an expansion joint 90 between the device 510 and box gutter section D/S. The expansion joint 90 is in the form of a resiliently expandable and contractible expansion strip, such as an Aquarius expansion joint of the type that is used to form a thermally adjustable connection between successive, directly interconnected box gutter sections. The expansion strip joint 90 is secured between the connector plate 86 and the upstream end of the downstream gutter section, specifically around and between the U-shaped flange 88 of the connector plate 86 and a margin around the upstream end of the downstream gutter section D/S in the manner illustrated at www.aquariusdist.com.au/products/expansion-strip-joint/. Thus the strip comprising the joint 90 may have an elongate body of a resilient plastics material that has laterally undulated, longitudinally extending corrugations, with each side margin incorporating a respective flexible aluminium strip. One margin is secured around the U-shaped flange 88 by rivets or self-tapping screws applied through the aluminium strip, while the other margin is similarly secured around the leading end of the gutter section D/S, with each securement incorporating a silicone or similar sealant. Note that this expansion strip is only required at intervals prescribed by 3500.3, and will typically not be required at each overflow device. In fact, in many cases, it will not be required at all, depending on the overall length of the box gutter and the maximum prescribed distance between expansion joints. Where it is not required, the D/S gutter will connect straight into the connector system 84. Note also that HB39:2015 '*Installation code for metal roof and wall cladding*' requires expansion joints to be positioned at high points in the box gutter i.e. at the upstream end of the (mono-slope) gutters installed between the overflow devices of the present Invention.

Preferably, the upper edge of plate 86 may be folded over to provide a down-turned lip by which plate 86 is able to be engaged on the upper edge of second end wall 518 of device 510 and, if required, secured by rivets. Alternatively plate 86 may be mounted on the outer face of the second end wall 518 by rivets applied through a respective upper margin of plate 86 and wall 518. When this latter arrangement is adopted, a narrow strip of inverted V or U shape would be provided as a flashing for waterproofing purposes between the device 510 and the D/S box gutter.

As with overflow device 310 of FIG. 4, each of devices 410 and 510 of respective FIGS. 7 and 8 most preferably have a first sub-chamber or receptacle that has a volume below the height of the weir defined by the respective common wall that is not substantially less than the volume of the second sub-chamber or receptacle below that height.

The overflow design according to the present invention may be specifically designed for each installation within the roof guttering system for the design catchment area of roof, and design rainfall intensity in accordance with 3500.3 Alternatively, the device may be manufactured in a number of pre-set sizes, such that the nearest size have a hydraulic capacity at least equal to the required design hydraulic capacity is selected. It is anticipated that the pre-set sizes will be the more likely commercialization form of the device.

When the overflow device 510 is supplied in a pre-set size, the height of walls 510, 518 and 520 will be such as to accommodate the maximum design box gutter depth corresponding to the design hydraulic capacity of the device 510, plus a height corresponding to the slope in the box gutter multiplied by the estimated maximum box gutter length. This will typically result in these walls being higher than necessary for the particular installation, and consequently it will be necessary to reduce their height by trimming a margin from the upper edges of walls 518, 520 and 521, as shown by dotted lines along the upper extent of walls 518, 520 and 521. Similarly, the connector system will be supplied with a maximum anticipated height, and will also typically be required to be trimmed, as indicated by the dashed lines near the top of 88. Note that the expansion strip 90, where required, is simply supplied at the required length (cut from a roll of this material).

In the arrangement of FIGS. 9A and 10A, and also the alternative arrangement of FIGS. 9B and 10B, there is a box gutter system installed along an external wall W. In each case, the gutter system is similar to that shown in FIG. 8. For ease of reference and brevity, the reference numerals of FIG. 8 are used in the arrangement for FIGS. 9A and 10A, and for that of FIGS. 9B and 10B, to designate corresponding parts and the description of FIG. 8 again applies in each arrangement. Depending on architectural requirements, constraints or both, the normal downpipe Pn, from outlet 276, may either be located externally, as illustrated in FIGS. 9A and 10A, or internally, as shown in FIGS. 9B and 10B, with the overflow downpipe Po, from outlet 278, located externally in each case. In the arrangement of FIGS. 9A and 10A, the downpipe Pn can pass through the adjacent external wall W and then down to connect into a below ground storm water drainage system. In the arrangement of FIGS. 9A and 10A, in which each of downpipes Pn and Po is located externally, they each most preferably pass through the external wall W at the same vertical height. After passing through the external wall, the overflow pipe Po preferably would be bent downwards to avoid an open horizontal pipe in which birds could nest. Additionally, if the overflow pipe Po is bent downwards, and the normal downpipe Pn is located externally, a decorative metal (or another suitable material) cover piece could be provided over both downpipes where they penetrate the external wall, and the arrangement would then have a similar appearance to conventional rainhead and downpipe. Similarly, where only the overflow pipe Po passes through the external wall, as shown in FIGS. 9B and 10B, a decorative metal piece could be provided to cover it. While not shown, the decorative cover piece could take various geometric forms, such as prismatic, or semi-elliptical, depending on the architectural requirements.

The arrangements in FIGS. 9A and 9B represent the use of the Invention such as to provide an alternative to the conventional sump/side overflow of FIG. 2. However, where the box gutter is instead perpendicular to the external wall, similar configurations are possible such as for the Invention to provide an alternative to the conventional rainhead of FIG. 1. These arrangements may differ slightly; for example, when both pipes Pn and Po penetrate the external wall, in order to allow for these penetrations to be at the same vertical level in the external wall, the pipes Pn and Po may be both laterally offset (in plan view) from the centerline of the box gutter and Invention to the extent required such that they do not clash.

The invention claimed is:

1. An overflow device comprising a sump for a box gutter, wherein the device includes: a primary sump receptacle defined by first and second opposed end walls, an opposed pair of primary sump sidewalls each extending between a respective side edge of each of the first and second end walls, the primary receptacle having a first basal wall extending between a lower edge of each of the first and second end walls and also between a respective lower edge of each of the primary sump opposed sidewalls and a primary outlet port for the discharge of water received therein, the primary outlet port adapted for connection to a primary downpipe by which water discharging from the primary receptacle is disposable; the second of the opposed end walls is a common wall in forming a first end wall of a secondary sump receptacle, with the secondary sump receptacle having a third end wall opposed to the common wall, opposed sides each comprising a sidewall extension of a respective side wall of the primary sump receptacle and extending between a respective side edge of each of the common wall and the third end wall, a second basal wall extending between a lower edge of each of the third end wall and the common wall and a respective lower edge of each sidewall extension and a secondary outlet for the discharge of water received therein, the secondary outlet adapted for connection to a secondary downpipe by which water discharging from the secondary receptacle is disposable, wherein the common wall has an upper edge that is spaced below a respective upper edge of each of the first end wall of the primary receptacle, the third end wall of the secondary receptacle, the opposed sidewalls and of each sidewall extension, and wherein the overflow device has a width between the side walls and between the sidewall extensions that is at least equal to the width of the box gutter whereby the overflow device is adapted to be installed in relation to at least a first section of the box gutter such that:

(i) the first end wall of the primary sump receptacle extends transversely with respect to the box gutter to enable the overflow device to be sealed to the first section of the box gutter; and (ii) the overflow device is adapted to be installed, if required, in relation to a second section of the box gutter such that the third end wall extends transversely with respect to the box gutter for sealing the overflow device to the second section of the box gutter; and wherein the arrangement is such that, with the overflow device so installed in relation to at least the first section of the box gutter, water is able to flow from the first section of the box gutter, over the upper edge of the first end wall of the primary receptacle, into the primary receptacle for discharge through the primary outlet port and into the primary downpipe, such that when discharge through the primary outlet port is sufficiently blocked, water then is able to overflow an upper edge of the common wall to be received into the secondary receptacle and discharged through the secondary outlet port and into the secondary downpipe.

2. The overflow device of claim 1, wherein each of the overflow device, the primary sump receptacle and the secondary sump receptacle, are substantially rectangular in top plan view, with the opposed sidewalls and the sidewall extensions being substantially parallel with each other, with the end walls including the common wall substantially parallel with each other and substantially normal to the side walls, and the first and second basal walls are substantially coplanar.

3. The overflow device of claim 1, wherein the primary sump receptacle has a volume, between the first basal wall of the primary receptacle and the upper edge of the common wall, which is not substantially less than a volume of the secondary sump receptacle, between the second basal wall of the secondary receptacle and the upper edge of the common wall.

4. The overflow device of claim 3, wherein the volumes are substantially equal or the volume the secondary receptacle exceeds that of the primary receptacle at least such that, in the event that flow from the primary outlet port of the primary receptacle being blocked to cause overflow to the second receptacle, any overflow from the primary receptacle to the second receptacle, up to a design hydraulic capacity for the device, can be accommodated by the volume of the second receptacle and designed discharge from the secondary outlet port.

5. The overflow device of claim 3, wherein the primary receptacle is such that, with the primary outlet port unobstructed and free to provide designed discharge of water from the primary receptacle, the volume of the primary receptacle, relative to a box gutter appropriate for a given roofing form and geographic location, is such that the overflow device is able to accommodate rainfall intensities for a duration of five minutes and an ARI of 100 years.

6. The overflow device of claim 1, wherein the first end wall has an upper edge that is intermediate in height between the height of the common wall on the one hand and the height of each of the third end wall and the side walls, whereby the clutter has a terminal end that is able to rest on the upper edge of the first end wall, between the side walls, of the device.

7. The overflow device of claim 6, wherein the third end wall and the side walls have a substantially common height above the, or each, basal wall.

8. The overflow device of claim 6, wherein the overflow device is suitable to enable positioning at a required location relative to the area of roofing with which the overflow device is to be used before the box gutter is installed.

9. The overflow device of claim 8, wherein the overflow device is made available in a number of pre-set sizes, enabling selection of a device of a required size and hydraulic flow capacity for a given box gutter size and hydraulic flow capacity.

10. The overflow device of claim 9, wherein the overall height of the overflow device and connector allow for a maximum design hydraulic capacity of the box gutter plus an allowance for the estimated maximum fall in the box gutter, and such that the top of overflow device and connector can be trimmed to a required height to suit the particular installation to enable alignment of the top of the box gutters and the overflow device at a common level at an underside of roof sheeting where the sheeting intersects the side walls of the box gutter.

11. The overflow device of claim 1, wherein the overflow device is adapted for installation between ends of successive box gutter sections to enable water to flow in a common direction in each of the gutter sections such that water flows into the overflow device from an upstream one of the gutter sections, and away from the overflow device in a downstream one of the gutter sections, and wherein the downstream gutter section has an upstream end mounted in relation to the third end wall of the overflow device, in a manner such that a sole or pan of the downstream gutter section is above the upper edge of the first end wall and below the upper edge of the third end wall.

12. The overflow device of claim 11, wherein the downstream gutter section is mountable in relation to the third end wall of the overflow device by a connector.

13. The overflow device of claim 12, wherein the connector comprises a plate mountable on the overflow device with a first of opposite main faces of the plate against an outer surface of the third end wall of the overflow device, with the plate having a flange projecting beyond the second of the opposite main faces, away from the first main face, by which the upstream end of the downstream gutter section can be supported on, or secured in relation to, the plate.

14. The overflow device of claim 13, wherein the flange forms a web portion of a U-shaped flange, with the U-shaped flange having upstanding side flange portions against or adjacent each of which is located a respective side wall of the downstream gutter section, when that upstream end of the downstream gutter section is so supported or secured.

15. The overflow device of claim 12, wherein the upstream end of the downstream gutter section can be supported or secured in a manner enabling longitudinal thermal expansion or contraction in the box gutter.

16. The overflow device of claim 15, wherein longitudinal thermal expansion is enabled by an expansion joint between the overflow device and the downstream box gutter section, wherein the expansion strip joint comprises a resiliently expandable and contractible strip.

* * * * *